US007290768B2

(12) United States Patent
Viarrial, Jr.

(10) Patent No.: US 7,290,768 B2
(45) Date of Patent: Nov. 6, 2007

(54) RAFFLE GAME USING FLAMABLE MATCHES AND MATCH CARRIERS AS PRINTABLE MEDIUM FOR RAFFLE GAME NUMBERS

(76) Inventor: Ralph Edward Viarrial, Jr., P.O. Box 3293, Santa Fe, NM (US) 87506

( * ) Notice: Subject to any disclaimer, the term of this patent is extended or adjusted under 35 U.S.C. 154(b) by 0 days.

(21) Appl. No.: 10/918,810

(22) Filed: Aug. 16, 2004

(65) Prior Publication Data

US 2006/0033279 A1 Feb. 16, 2006

(51) Int. Cl.
*A63F 1/02* (2006.01)

(52) U.S. Cl. ..... 273/292; 273/138.1; 273/139; 273/459; 273/293; 273/294; 206/96; 206/99; 206/103; 206/104; D9/701

(58) Field of Classification Search ..... 273/292, 273/138.1, 139, 293, 294, 459; 463/13, 12; D9/701; 206/96, 99, 103, 104
See application file for complete search history.

(56) References Cited

U.S. PATENT DOCUMENTS 5,092,598 A * 3/1992 Kamille ..... 273/139
5,407,199 A * 4/1995 Gumina ..... 273/139

* cited by examiner

*Primary Examiner*—Benjamin Layno
(74) *Attorney, Agent, or Firm*—Luis M. Ortiz; Kermit D. Lopez; Ortiz & Lopez, PLLC

(57) ABSTRACT

Game played using match-related medium for printing gaming instructions and indicia. At least one of interior surfaces of a matchbook or matchbox carrier is printed with gaming indicia used for comparison against gaming indicia printed at least one of match sticks or match splints. Game instructions are also printed on the interior surfaces of the matchbook or matchbox carrier. A serial number printed on at least one of the matchbook, matchbox, matchstick or match splint provides control over the game. Game indicia is related to at least one of: Five-card Poker, Seven-card Poker; Pai Gow Poker, Baccarat, lotteries and raffles.

10 Claims, 4 Drawing Sheets

RAFFLE GAME USING FLAMABLE MATCHES AND MATCH CARRIERS AS PRINTABLE MEDIUM FOR RAFFLE GAME NUMBERS

FIELD OF THE INVENTION

The present invention is generally related to gaming (e.g., casino, lottery, raffles). The present invention is also related to matchbooks matches and match sticks used as a printable medium for advertising purposes. More particularly, the present invention is related to particular gaming methods utilizing surfaces of match-related mediums (matchbooks, matchboxes, matches/splints and matchsticks) for printed game-related indicia, artwork, instructions and advertising.

BACKGROUND

The following U.S. patents are herein incorporated by reference. U.S. Pat. No. 1,728,509 entitled "Match book," issued to Rahe; U.S. Pat. No. 1,885,076 entitled "Advertising Novelty," issued to Bustamante; U.S. Pat. No. 2,105,842 entitled "Safety Match Packet," issued to Pindell; U.S. Pat. No. 2,157,740 entitled "Commercial Package," issued to Quinlan; U.S. Pat. No. 2,254,545 entitled, "Match Book," issued to Roberts; and U.S. Pat. No. 6,042,113 entitled Handheld Matchbook-simulating Games and Gifts," issued to Walker.

Matchbooks have been utilized for advertising and gaming purposes. The incorporated patents are examples of how matchbooks and splints are used as printable mediums. Roberts in particular was issued in 1941 and describes use of a matchbook and splints to represent "poker hands." The poker hands are normally concealed from view so that persons acquiring the match books can compare their relative "hands" with another player after breaking the seals and thereby simulate poker gaming or some other game depending upon the character of the representations. The Walker patent which was issued in 2000, 59 years after Roberts, is a more recent example of another game that utilizes a common match book to carry out its entertainment medium.

Matchbooks are still in wide use as a giveaway at public establishments, such as casinos, restaurants and lounges. Advertising is conducted using matchbooks and matchstick carriers. A matchbook or match stick holder is effective as an advertising medium because it is typically retained by the user for longer periods of time than a flyer or brochure; therefore any message imprinted on the match book or match box is repeatedly read by the user.

The present inventor believes that lottery gaming and other casino-related games can be played using match sticks, match splints, matchbooks and matchboxes as the gaming medium; whether the match-related gaming is for actual profit, or just for entertainment and advertising purposes. If such medium were used for gaming, the user would benefit from further use of the gaming medium even if the game has expired. Advertising can accompany the game so that additional revenue can be generated from sponsors by state-managed games or casinos utilizing match holders for their over-the-counter gaming.

SUMMARY OF THE INVENTION

Accordingly, it is a feature of the present invention to provide a new medium for lottery gaming and other casino-related games to be played.

In accordance with unique feature of the present invention, match sticks, match splints, matchbooks and matchboxes are utilized as the medium for carrying out casino-like card games, lotteries and raffles.

In accordance with features of the invention, match-related media can be used whether the match-related gaming is for actual profit, or just for entertainment and advertising purposes. If such medium were used for gaming, the user can benefit from further use of the gaming medium even if the game has expired.

In accordance with another feature of the present invention, advertising can accompany the game so that additional revenue can be generated from sponsors by state-managed games or casinos utilizing match holders for their over-the-counter gaming.

In accordance with yet another feature of the present invention, inside surfaces of a matchbook are printed with gaming instructions, control numbers, serial numbers, winning outcome legends, and prize notifications.

In accordance with yet another feature of the present invention, games including at least one of Poker, Pai Gow, Baccarat, Powerball, and fundraising raffles are played and managed using match-related media.

DETAILED DESCRIPTION OF EMBODIMENTS FOR THE INVENTION

Figure 1:
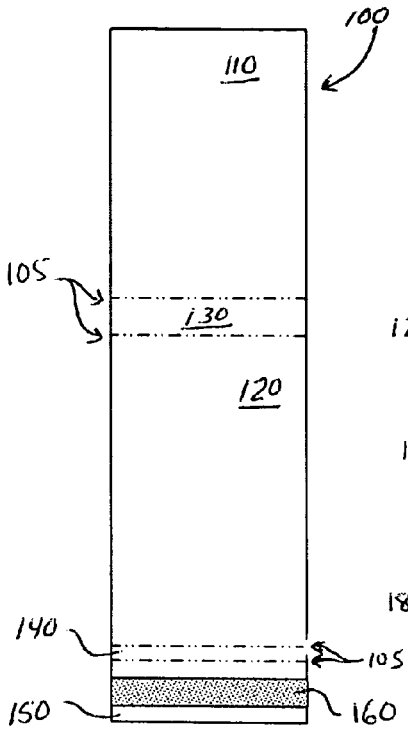
FIG 1 (PRIOR ART)
FIG. 1 (labeled prior art) illustrates a front view of the entire exterior surface of a prior art matchbook.
Figure 2:
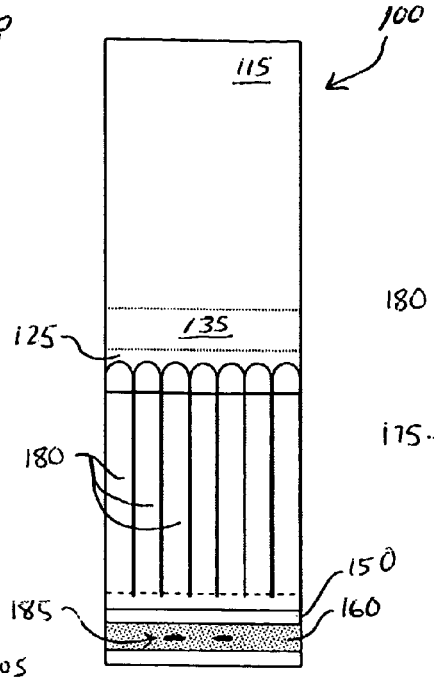
FIG 2 (PRIOR ART)
FIG. 2 (labeled prior art) illustrates an inside view of a prior art matchbook.

Referring to FIGS. 1-5 (labeled as prior art), a matchbook that is in common use will now be described. A matchbook 100 is generally formed from a rectangular piece of cardstock quality material. The matchbook 100 is defined by folds or creases 105 created along the rectangular piece of cardstock forming the front 110, back 120, top 130 and bottom 140 sections. The rectangular top 130 is defined by the folds 105 in the cardstock and operate to provide some separation between the front 110 and back 120 sections, which further provides space for splints 180 secured within the matchbook 100 as shown in FIG. 2.

Figure 3:
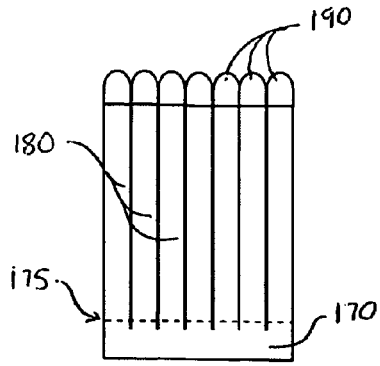
FIG 3 (PRIOR ART)
FIG. 3 (labeled prior art) illustrates a front view of a prior art match splint panel.
Figure 4:
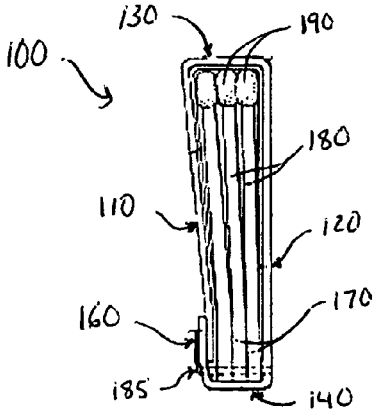
FIG 4 (PRIOR ART)
FIG. 4 (labeled prior art) illustrates a side view of a prior art matchbook fully closed.
Figure 5:
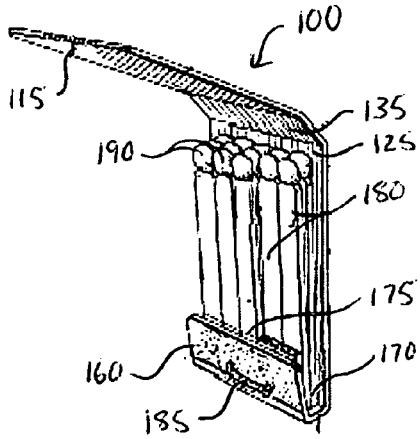
FIG 5 (PRIOR ART)
FIG. 5 (labeled prior art) illustrates a perspective view of a prior art matchbook partially opened.

Referring to FIGS. 2 and 3, a plurality of splints 180 contained within the matchbook 100 are commonly formed as flat panels 170 (typically three rows of panels containing about seven splints each, for a total of twenty-one matches) and rest against the interior-back surface 125 of the matchbook 100. The panels 170 are secured beneath the retaining flap surface 150 by a staple 185 when the matchbook 100 is opened. Each group of splints 180 is commonly connected at the lower portion of the panels 170 under the retaining flap 150. A portion of the back surface located near the bottom of the matchbook 100 is folded around the lower portion of the panels 170 for each row of splints. The tips 190 for each individual splint, located opposite their common connection at the lower portion of the panel, contains a bulb of ignitable, combustible material that will burn when the bulb is struck/rubbed against a course surface 160.

The front section 110 of the matchbook operates as a protective flap and opening cover that enables a user to access the splints 180 contained within the matchbook 100. The interior surface 115 is only visible when the front section 150 is opened, thereby exposing the interior surfaces 115, 125 of the matchbook 100, and the splints 180. The interior surface 115 of the cover 110 is located above the panels 170 when they are secured within the bottom section of the matchbook 100. The interior 115, 135 and exterior front 110, back 120 and top 130 surfaces of the matchbook 100 provide adequate space for advertisements and other printed media. The back exterior surface 120 of the matchbook 100, however, provides the greatest area for printing advertisements, including text, logos and designs. The interior surface of the front section 115 (under the protective flap) can also be used for printed media and is probably viewed most often by the user during matchbook use.

The lower portion of the back surface 140 that is creased or folded 105 over the lower portion of the panels 170, and forms the bottom section 140 of the matchbook, operates as a retaining flap 150. A striking strip/pad 160 is typically formed along the outer surface of the retaining flap 150. A staple 185 is typically secured through the lower portion of the back surface 120 and retaining flap 150 causing the panels 170 to be held firmly within the match book 100 inside the folds 105 created between the inside back surface 120 and front retaining flap 150. When splints 180 are not in use or are brand new, the protective flap 110/115 is folded downward at a crease 105 formed at the protective flap's connection with a saddle 130/135, and the protective flap 110/115 is tucked behind the front retaining flap 150 above the staple 185. During use, splints 180 are torn apart from their connection to the base of the panels 170. The splints 180 are easy to tear away from the panels 170 because perforations are usually formed near the base of the panels 170 when the splints 180 are connected.

Figure 7:
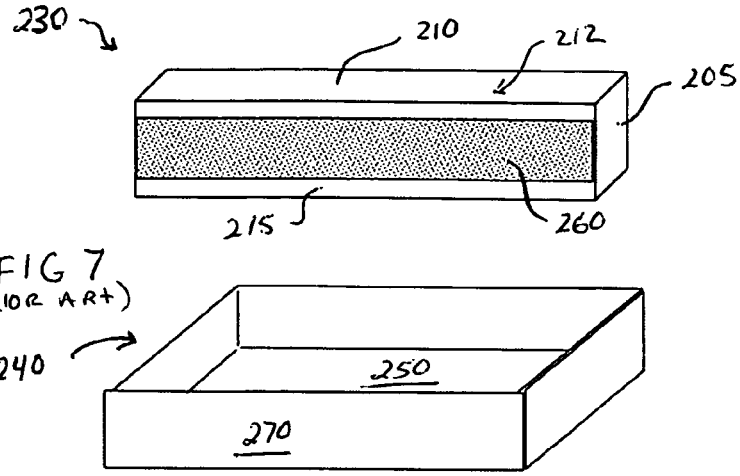
FIG 7 (PRIOR ART)
FIG. 7 (labeled prior art) illustrates a perspective view of a matchbox and matchstick carrier.
Figure 6:
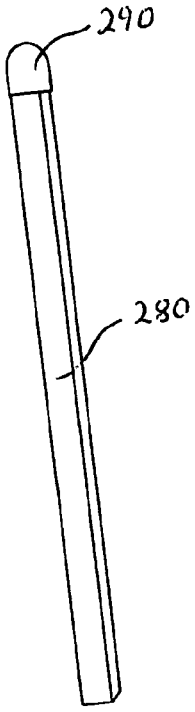
FIG 6 (PRIOR ART)
FIG. 6 (labeled prior art) illustrates a perspective view of a matchstick
Figure 8:
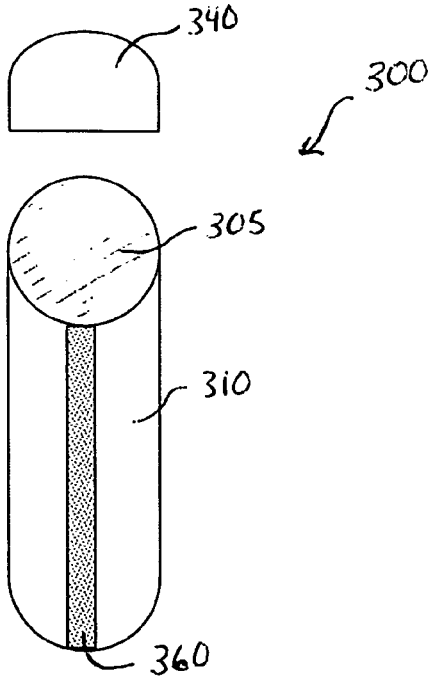
FIG 8 (PRIOR ART)
FIG. 8 (labeled prior art) illustrates a perspective view of a cylindrical matchstick carrier and end cap.

Referring to FIGS. 6-8, matchsticks 280 are not held together within a book-like housing, but are typically stored within a protective container 230/240. Like the book-held matches, each match stick 280 has a bulb 290 of flammable, ignitable material on one of its ends (tips). The protective container can be provided in different form factors, including boxes 230/240 and tubes 300. Match boxes typically have an outer shell 230 and a carrier 240. The outer shell 230 is defined four outer surfaces 210 (top, bottom, and two sides) and at least one opening 205 formed at either end of the shell 230. A carrier 240 having a bottom 250 and four sides 270 holds the match sticks. The width of the carrier 240 is slightly smaller than the opening formed by the four sides of the shell 230, which enables the carrier 240 to be slid into the shell 230 for storage and containment of match sticks 280 being held within the carrier 240. Advertising and text is typically printed on the top 210 and bottom (not shown) surfaces of the shell 230, while a course striking pad 260 is typically integrated with at least one of the two sides 215 of the shell 230. Striking pads 260 are sometimes known to be colored.

When a tube 300 is used to hold match sticks 280, only one end of the tube 300 will typically be opened 305. The opening 305 at the end of the tube is adapted to accept and retain a cap 340. The striking surface 360 will typically be located along the surface 310 (circular side) of the tube 300, or at the tube's bottom surface (not shown). Match sticks 280 are held within the tube 300 and cap 340, and can be accessed by removal of the cap 340.

Figure 9:
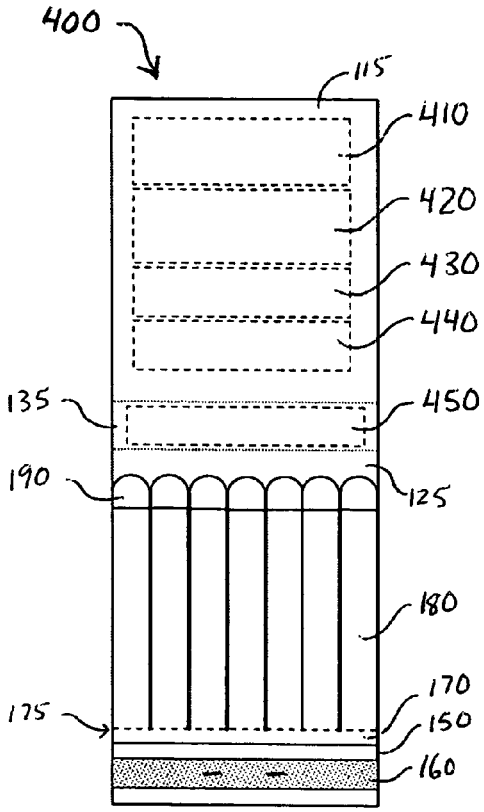
FIG. 9 illustrates a front view of a matchbook in accordance with features of the present invention.
Figure 10:
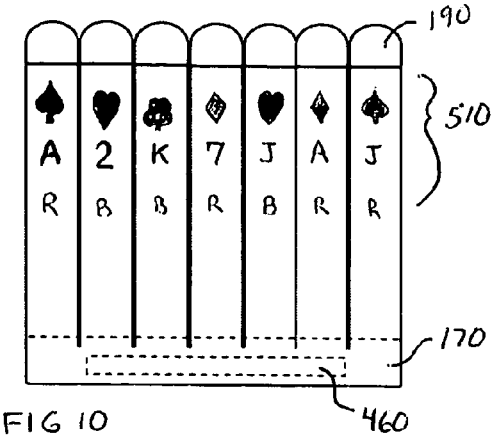
FIG. 10 illustrates a front view of a match-splint panel used for casino-related card gaming in accordance with features of the present invention.
Figure 11:
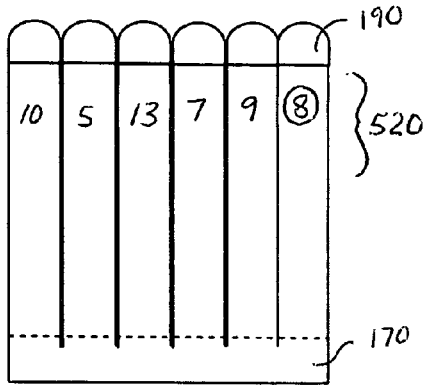
FIG. 11 illustrates a front view of a match-splint panel used for lottery-related card gaming in accordance with features of the present invention.
Figure 12:
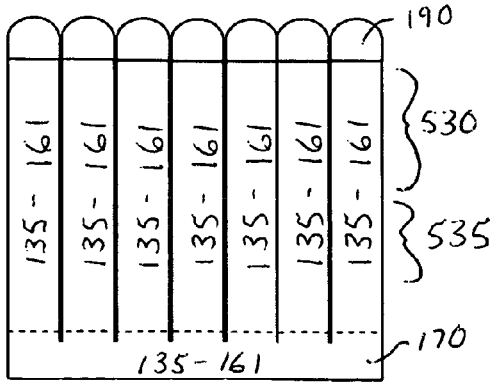
FIG. 12 illustrates a front view of a match-splint panel used for fund raising-related lotteries in accordance with features of the present invention.

In accordance with carrying out features of the present invention, advertising and a game identity can be printed on the outer surfaces of the match book as illustrated above. As shown in elements 410-450 in FIG. 9, instructions for a particular game are printed at least one of the top front inside cover 115 or interior back surface 125 of a match book 400. It is also contemplated that a security/control number can be printed in elements 410-450 of the matchbook 400. It can now be appreaciated from the foregoing description that security numbers and other game-related indicia can be printed on at least one of the inside portion of the top 450, striking pad 160 and the lower portion 460 of any or all of the panels 170. The splints 180 associated with each panel 170 are each printable with gaming indicia 510, 520, 530 and 535, as shown in FIGS. 10-12 (e.g., card game hands or lottery numbers). The panels will include at least five to seven splints in order to accommodate a typical poker hand, or lottery numbers associated with well known lottery games like the PowerBall.

Figure 13:
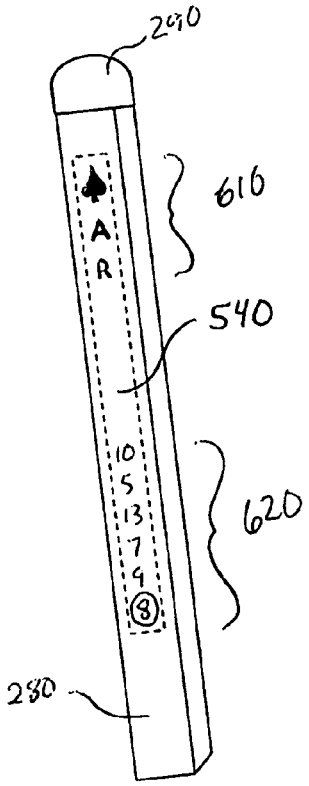
FIG. 13 illustrates a perspective view of a matchstick used for gaming in accordance with features of the present invention.
Figure 14:
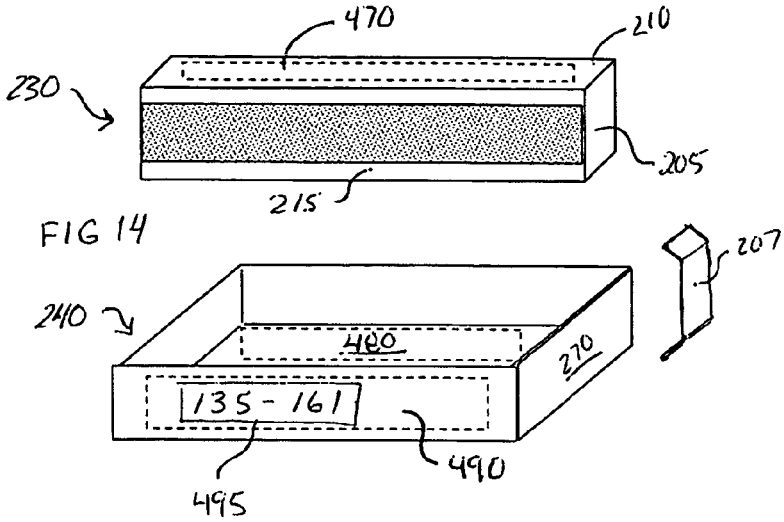
FIG. 14 illustrates a perspective view of a matchbox assembly used for gaming in accordance with features of the present invention.

Referring to FIGS. 13-14, match boxes 230/240 and match sticks 280 can provide areas 540 that can be custom printed for gaming and advertising purposes. The match stick 280 typically has four sides. At least one of the sides is imprintable with gaming indicia such as card game hands 610 or lottery numbers 620. All four sides can also be printed with similar indicia. The combustible bulb 290 is again located at the tip of the match stick 280.

Figure 15:
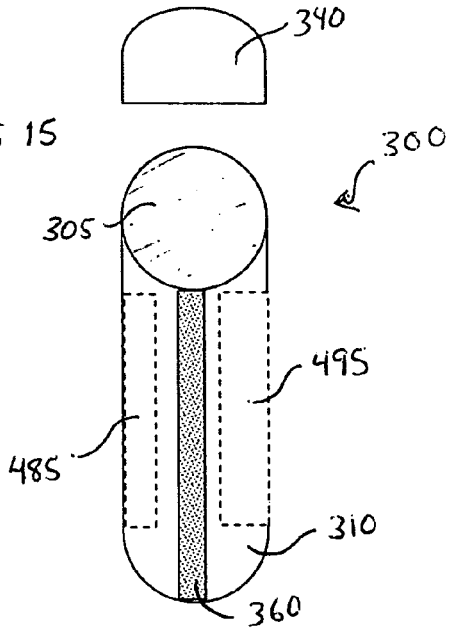
FIG. 15 illustrates a perspective view of a cylindrical matchstick carrier used for gaming in accordance with features of the present invention.

The match box used to protectively carry the match sticks can be imprinted on an area 470 defined at the topside of the shell 230 with advertising and/or identification of the type of game that is contained on the match sticks 280 secured within the carrier 240 and shell 230. Rules for the game can be printed on the side or bottom (not shown) 215 of the shell 230. A protective security strip 207 can be wrapped around the openings of the shell 230. It can also be appreciated based on the foregoing description that a single security strip can be wrapped around the entire shell 230, thereby covering the two opened ends wherein the carrier 240 is retained, or separate security strips can be used to cover each open end. The shell 230 can also be designed to only have one open end 205 for accepting the carrier 240. It should be appreciated that additional instructions, security measures or game steps (e.g., prizes levels, rules) can also be printed or attached to the outer bottom surface 490 or interior bottom surface 480 of the carrier 240. When a tube carrier 300 is used as shown in FIG. 15, the game type, serial numbers, advertising can be printed on the outer surface 485/495 of the tube 300.

A poker hand typically consists of 5 cards; although seven card version of poker are also played. The Ace is considered the highest card, followed by Kings, Queens, Jacks, etc. The lowest card is a two. The object of the game is to get the best hand possible. Referring to FIGS. 9 and 10, a player is dealt a five-seven cards hand that is represented by printing 510 on each match splint 180, or as a combination of printing across 5-7 splints represented by a match panel 170 contained in the matchbook 400. If the player's new set of cards contains a winning hand as compared to the house/dealer, which is represented by a hand printed on the matchbook 400 in designated areas 410-460, the player gets paid. It can be appreciated that the house's hand can also be printed anywhere else on the inside surfaces of the matchbook or matchbox carrier and on the scratch pad 160.

For match sticks 280, each poker hand can be print along the side, or all sides, of the match stick 280. The starting point for the hand can begin nearest the flammable bulb 290. The hands can be matched against a dealer's imprinted on the carrier 480, or opposite the player's printed hand on the same matchstick, but on an opposing side. In this configuration, the player's hand must be distinguished from the dealer's. A distinction can be made with colored printing or a marker at the beginning or end of each match stick (e.g., red "R" and black "B"). Color can also be used with more sophisticated printing systems.

Typical poker hands are illustrated below:

Royal Flush—A Ten, Jack, Queen, King and Ace, all of the same suit.

Straight Flush—All five cards are consecutive and are the same suit (e.g. Three of Clubs, Four of Clubs, Five of Clubs, Six of Clubs and Seven of Clubs).

Four of a Kind—Four cards of the same value (e.g. 4 Queens).

Full House—A three of a kind and a pair at the same time (e.g. three aces and two fives.

Flush—All cards in the player's hand are the same suit, but they don't have to be in any order (Ace of Hearts, Three of Hearts, Six of Hearts, Jack of Hearts, Eight of Hearts).

Straight—All five cards are consecutive (e.g. Three of Clubs, Four of Spades, Five of Clubs, Six of Diamonds, and Seven of Hearts).

Three of a Kind—Three cards of the same value (e.g. three Jacks).

Two Pair—Two pairs of cards. In other words, two cards in the player's hand are the same value, and two other cards in the player's hand are also the same value (e.g. two 3's and two seven's).

Pair—Two cards in the player's hand are the same value. In some versions, they must be Jacks or better (e.g. two Kings).

Deuces Wild—In the 'Deuces Wild' version of Poker, all deuces are treated as wild cards (but any other card can also be picked as wild). This means that whenever a player gets a 2, the player can use that card as any card you like. The player can therefore change its face value and/or suit to work with the hand the player has. With Deuces Wild, the player has a far better chance of getting good hands. The casino compensates for this by offering a tighter payout schedule. The player only gets paid with a three of a kind or better.

Pai Gow poker is somewhat different from normal poker, though the desired hands remain almost the same. In a casino, Pai Gow poker is typcailly played with 53 cards, which is the standard 52 cards used in poker plus one joker, which can be used as an ace, or to compete a straight, flush or straight flush. In Pai Gow poker the player receives 7 cards to divide into one five-card hand and one two-card hand. A two-card hand can be either a pair or two single cards. The player then must make a five card hand with the seven cards which scores higher than the two-card hand. If the player's five-card hand beats the dealer's five-card hand and the player's two-card hand beats the dealer's two-card hand, the player wins the hand. If the dealer's five-card hand beats the player's five-card hand and the dealer's two-card hand beats the player's two-card hand, the dealer wins the hand. If the player and the dealer each win one hand, the result is a push, and the player receives his original bet back. If player fail to set her cards so that the five-card hand outscores the two-card hand, the player fouls and the dealer wins by default.

With the present invention, a seven splint panel can be used to play Pai Gow Poker as shown in FIG. 10. The first five splints can represent the five card hand, and the last two splints the two card hand. Hands printed on the panel can be compared with the dealer's hand printed on the matchbook 400 at locations 410-450 shown in FIG. 9 and location 460 shown in FIG. 10. More than one hand can be printed on the interior of the matchbook for comparison against the panels of splints. For match sticks, each Pai Gow hand can be print along the side, or all sides, of the match stick. The starting point for the hand can begin nearest the flammable bulb. The hands can be matched against a dealer's imprinted on the carrier, or opposite the player's printed hand on the same matchstick, but on an opposing side. In this configuration, the player's hand must be distinguished from the dealer's. A distinction can be made with colored printing or a marker at the beginning of the hand.

Baccarat (correctly pronounced "BAH-kah-rah") is played where the objective is to correctly predict whether the banker's hand will win, the player's hand will win, or the game will result in a tie. The value of a hand is determined by adding the values of its individual cards. Tens and face cards count as zero, while all other cards count as their numerical value. After summing the total, only the last digit is used. Therefore, baccarat hands all have values from 0-9. The hand with the higher value wins. If the hands have the same value, the game results in a tie.

Initially, both the banker and the player are dealt two cards in Baccarat. If the two initial cards total 8 or 9, the hand is called a "natural", and the game will end at that point. Otherwise, standard Baccarat "third card rules" determine if a hand should receive a third and final card. The goal of your two-card hand is to try and have a total that is close to 9.

Tens and face cards count as zero, with the exception of the ace, which is worth 1. Cards 2 thru 9 are worth their face value. The simplicity of baccarat rules reflects the simplicity of the scoring and goal itself. There is really only one tricky part: although there is no such thing as a 'busting hand' as in blackjack, when the player's initial card total is a two digit number, the first digit is dropped. Say the player is dealt a pair of sevens—the total is 14, but the count is set to 4, as the leading 1 is arbitrarily dropped. If the first two cards of a hand total 8 or 9 the hand is declared a 'natural' and wins (unless there is a tie between two naturals). If either hand is a natural, both hands stand, the natural hand wins. If the total is not a natural win on either hand, another card is drawn for each hand to determine the winner.

With the present invention, a seven splint panel as shown in FIG. 10 can be used to play Baccarat. The first two splints can represent the two card hand that is compared against the banker's hand imprinted on the inner surface of the matchbook 400 at locations 410-450 in FIG. 9 and location 460 shown in FIG. 10. Each additional splint following the first two splints can be added to the hand until there is a win or loss against the banker's hand, and the last two splints the two card hand. More than one game can be printed on the interior of the matchbook for comparison against the three panels of splints typically bound in a matchbook. For match sticks, each Baccarat hand can be print along the side, or all sides, of the match stick. The starting point for the hand can begin nearest the flammable bulb. The hands can be matched against a Banker's imprinted on the carrier, or opposite the player's printed hand on the same matchstick, but on an opposing side. In this configuration, the player's hand must be distinguished from the banker's. A distinction can be made with colored printing or a marker at the beginning of the hand.

For lottery games, such as PowerBall, each of the lottery numbers can be printed on the individual splints associated with each panel as shown in FIG. 11, with printing starting from left and moving to the right. Instructions for the lottery can be printed on the inside surfaces of the matchbook 400 at locations 410-450 shown in FIG. 9 and location 460 shown in FIG. 10. Advertising can be printed on the exterior surfaces 110 of the matchbook 100 as shown in FIG. 1.

Powerball is a widely known and played lottery game. Powerball is now played in 26 states, the District of Columbia, and the U.S. Virgin Islands. Maine will begin sales on July 30. The lotteries sold more than $2 billion in Powerball tickets in 2003. That translates into more than $600 million for worthwhile state projects.

Powerball is a lotto game which is a combined large jackpot game and a cash game. Every Wednesday and Saturday night at 10:59 p.m. Eastern Time, five white balls are drawn out of a drum with 53 balls and one red ball out of a drum with 42 red balls. Players win by matching one of the 9 Ways to Win. The jackpot (won by matching all five white balls in any order and the red Powerball) is either an annuitized prize paid out over 29 years (30 payments) or a lump sum payment. Players no longer have to select the payment option at the time of purchase. The tax law has changed to give you up to 60 days until after you claim the prize to decide whether you want cash or the annuity option. The second prize (won by matching five white balls in any order) is $100,000 paid in cash. Any time you match the red PowerBall, you win. The overall odds of winning a prize in the PowerBall game is claimed to be better than 1 in 36.06.

Power Play is a special feature that allows a winner to multiply the original prize amount. PowerBall players can multiply their PowerBall prizes by 2, 3, 4 or 5 times (does not include the jackpot). A player must choose the Power Play option when they buy their PowerBall ticket, and then the ticket must match one of the 9 ways to win before the multiplier takes effect. The following chart illustrates the nine published ways to win PowerBall including prizes and odds.

| Match | Prize | Odds |
|---|---|---|
| Five numbers + PowerBall number | Grand Prize | 1 in 120,526,770.00 |
| Five numbers | $100,000 | 1 in 2,939,677.32 |
| Four numbers + PowerBall number | $5,000 | 1 in 502,194.88 |
| Four numbers | $100 | 1 in 12,248.66 |
| Three numbers + PowerBall number | $100 | 1 in 10,685.00 |
| Three numbers | $7 | 1 in 260.61 |
| Two numbers + PowerBall number | $7 | 1 in 696.85 |
| One number + PowerBall number | $4 | 1 in 123.88 |
| One number | $3 | 1 in 70.39 |

The overall odds of winning a prize are 1 in 36.06.
The odds presented here are based on a $1 play and are rounded to two decimal places.

Lottery tickets are printed for use in association with a state-sponsored lottery game. The majority of lottery tickets are discarded after the game is played because the majority of tickets are "losing" tickets. Unfortunately, the cardstock used for lotteries is becomes waste and provides no other benefit to its user.

For lottery played on matchsticks, the lottery numbers can be printed on at least one side of the matchstick starting from the top of the matchstick nearest the combustible bulb, on down to the bottom of the match stick. Example lottery numbers 620 are shown on the matchstick 540 in FIG. 13. Lottery numbers can also be placed on the interior surfaces of the matchbox at location 480 and 490, and on the side panel at locations 485/485 shown in FIG. 15.

Pull tabs are typically used for raffles and fundraisers. A donor purchases one or more pull tabs for an item of interest that is being auctioned at an event. The serial number on each pull tab matches the serial number for the pull tab holder from which it is detached. Once all the pull tabs from a given holder are purchased, the winning number of the winning pull tab is announced. Pull tab holders examine their pull tabs to see if there pull tabs match the winning number. The holder of the winning pull tab wins the prize if the pull tab matches the serial number and winning number match the pull tab holder. It should now be appreciated given the teachings of the various embodiments herein that pull tabs can be replaced by matchboxes and matchbooks described herein. As shown in FIG. 12, winning pull tab numbers 530 and serial numbers 535 can be imprinted on the splints, as well as the interior surfaces 410-450 of the matchbook 400 shown in FIG. 9. The winning number can also be printed on matchsticks 280 or on the surfaces associated with the matchstick carrier as shown by element 495 in FIG. 14. A master matchbook which contains the serial number for the series of match-related items as well as the winning number can be used for identifying/confirming the winning match-related item. The master does not have to be in the form of a matchbook, but can also be provided in a card-like format that is packaged with the matchbooks or matchboxes being sold as part of the fundraiser.

The invention claimed is:

1. A business method carried out at a gaming entity comprising providing a game in exchange for money from a casino, said game including the use of match-related media having at least one of interior surfaces of a matchbook and a surface of at least one match splint, the match-related media bearing printed gaming indicia and gaming instructions, the business method further comprising the steps of:

the gaming entity providing the match-related media to a game player in exchange for money, the match-related media further comprising gaming indicia including at least one of a raffle number or lottery number, including gaming instructions and including a game control number printed thereon said gaming entity announcing a winning number enabling said game player to compare said at least one raffle number or lottery number to the winning number that is announced; and said gaming entity providing a prize to the game player if said at least one of a raffle number or lottery number matches the winning number that was announced and if said game control number printed on said match-related media matches a game control number held by the gaming entity.

2. The method of playing a game of claim 1 wherein the at least one of the interior surfaces the matchbook are also printed with poker game indicia representing a dealer's hand and wherein poker game indicia representing a player's hand is printed on at least one of the match splint, wherein the dealer's hand is used for comparison of the player's hand to determine whether the player wins the poker game and a prize.

3. The method of playing a game of claim 2 wherein the poker game indicia is for Pai Gow Poker.

4. The method of playing a game of claim 2 wherein the poker game indicia is for Baccarat.

5. The of claim 2 further comprising advertising media printed on at least one of the exterior surfaces of the matchbook.

6. The of claim 1 further comprising advertising media printed on at least one of the exterior surfaces of the matchbook.

7. A business method carried out at a gaming entity comprising providing a game in exchange for money from a casino, said game including the use of match-related media having at least one of interior surfaces of a matchbook, and a surface of at least one match splint, the match-related media bearing printed gaming indicia and gaming instructions, the business method further comprising the steps of:

the gaming entity providing the match-related media to a game player in exchange for money, the match-related media further comprising gaming indicia including poker game indicia wherein poker game indicia representing a player's hand is printed on at least one of the match splint and wherein a dealer's hand is used for comparison with the player's hand to determine whether the player wins the poker game and a prize, the match related media also including gaming instructions and a control number printed thereon; and said gaming entity providing a prize to the game player if it is determined that said player's hand printed on at least one of the match splint beats the dealer's hand after comparison of the player's hand to the dealer's hand and if said game control number printed on said match-related media matches a game control number held by the gaming entity.

8. The method of playing a game of claim 7 wherein the poker game indicia is for Pai Gow Poker.

9. The method of playing a game of claim 7 wherein the poker game indicia is for Baccarat.

10. The method of playing a game of claim 7 wherein the at least one of the interior surfaces the matchbook are also printed with at least one of a lottery number or a raffle number and wherein said gaming entity provides the game prizes or money if said at least one of a raffle number or lottery number matches a winning number announced by the gaming entity and if said game control number printed on said match-related media matches a game control number held by said gaming entity.

* * * * *